US011944866B2

(12) United States Patent
Rogus

(10) Patent No.: US 11,944,866 B2
(45) Date of Patent: Apr. 2, 2024

(54) EXERCISE MACHINES HAVING ADJUSTABLE ELLIPTICAL STRIDING MOTION

(71) Applicant: Life Fitness, LLC, Franklin Park, IL (US)

(72) Inventor: John M. Rogus, Northbrook, IL (US)

(73) Assignee: Life Fitness, LLC, Franklin Park, IL (US)

( * ) Notice: Subject to any disclaimer, the term of this patent is extended or adjusted under 35 U.S.C. 154(b) by 0 days.

(21) Appl. No.: 17/954,042

(22) Filed: Sep. 27, 2022

(65) Prior Publication Data

US 2023/0016869 A1 Jan. 19, 2023

Related U.S. Application Data

(63) Continuation of application No. 17/172,468, filed on Feb. 10, 2021, now Pat. No. 11,484,749, which is a continuation of application No. 16/042,002, filed on Jul. 23, 2018, now Pat. No. 10,946,238.

(51) Int. Cl.

| | |
|---|---|
| ***A63B 22/06*** | (2006.01) |
| ***A63B 22/00*** | (2006.01) |
| *A63B 71/06* | (2006.01) |

(52) U.S. Cl.

CPC ..... *A63B 22/0664* (2013.01); *A63B 22/001* (2013.01); *A63B 22/0015* (2013.01); *A63B 2022/067* (2013.01); *A63B 71/0622* (2013.01)

(58) Field of Classification Search

CPC ..... A63B 22/0664–0694

See application file for complete search history.

(56) References Cited

U.S. PATENT DOCUMENTS

| | | | |
|---|---|---|---|
| 2,641,249 | A | 6/1953 | Brockman |
| 3,316,898 | A | 5/1967 | Brown |
| 3,917,261 | A | 11/1975 | Small et al. |
| 4,376,532 | A | 3/1983 | Hunstad |

(Continued)

FOREIGN PATENT DOCUMENTS

| | | |
|---|---|---|
| EP | 2223722 | 9/2010 |
| TW | I579019 | 4/2017 |
| WO | 2008114291 | 9/2008 |

OTHER PUBLICATIONS

Hybrid Generator Brake (FB6), Chi Hua Fitness Co., http://www.chihua.com.tw/zh-tw/product, date website visited Jun. 25, 2018.

(Continued)

*Primary Examiner* — Nyca T Nguyen

(74) *Attorney, Agent, or Firm* — Andrus Intellectual Property Law, LLP

(57) ABSTRACT

An exercise machine is for performing a striding exercise motion. The exercise machine has frame; first and second pedal members; first and second foot pads on the first and second pedal members, respectively, each of the first and second foot pads being configured to move in an elliptical path during the striding exercise motion; first and second rocker arms pivotally coupled to the frame; and first and second adjustment devices configured to actively adjust and set a position of the first and second pedal members relative to the first and second rocker arms, respectively, which thereby changes a shape of the elliptical path.

18 Claims, 13 Drawing Sheets

(56) References Cited

U.S. PATENT DOCUMENTS 4,408,613 A 10/1983 Relyea
4,587,960 A 5/1986 Schotten
4,786,050 A 11/1988 Geschwender
4,915,375 A 4/1990 Ginsburg
5,067,710 A 11/1991 Watterson et al.
5,135,447 A 8/1992 Robards, Jr. et al.
5,149,084 A 9/1992 Dalebout et al.
5,242,343 A 9/1993 Miller
5,290,211 A 3/1994 Stearns
5,383,829 A 1/1995 Miller
5,411,454 A 5/1995 Chang
5,419,751 A 5/1995 Byrd et al.
5,478,295 A 12/1995 Fracchia
5,499,956 A 3/1996 Habing et al.
5,540,637 A 7/1996 Rodgers, Jr.
5,562,574 A 10/1996 Miller
5,573,480 A * 11/1996 Rodgers, Jr. ..... A63B 22/0664 482/52
5,624,356 A 4/1997 Roberts
5,685,804 A 11/1997 Whan Tong et al.
5,743,834 A 4/1998 Rodgers, Jr.
5,759,136 A 6/1998 Chen
5,762,588 A 6/1998 Chen
5,779,599 A 7/1998 Chen
5,785,632 A 7/1998 Greenberg et al.
5,788,610 A 8/1998 Eschenbach
5,792,026 A 8/1998 Maresh et al.
5,803,871 A 9/1998 Stearns et al.
5,836,854 A 11/1998 Kuo
5,836,855 A 11/1998 Eschenbach
5,848,954 A 12/1998 Stearns et al.
5,857,941 A 1/1999 Maresh et al.
5,882,281 A 3/1999 Stearns et al.
5,893,820 A 4/1999 Maresh
5,895,339 A 4/1999 Maresh
5,899,833 A 5/1999 Ryan et al.
5,919,118 A 7/1999 Stearns et al.
5,921,894 A 7/1999 Eschenbach
5,928,113 A 7/1999 Roberts
5,938,568 A 8/1999 Maresh et al.
5,947,872 A 9/1999 Ryan et al.
5,957,814 A 9/1999 Eschenbach
5,993,359 A 11/1999 Eschenbach
6,007,462 A 12/1999 Chen
6,027,430 A 2/2000 Stearns et al.
6,027,431 A 2/2000 Stearns et al.
6,030,320 A 2/2000 Stearns et al.
6,042,512 A 3/2000 Eschenbach
6,045,488 A 4/2000 Eschenbach
6,053,847 A 4/2000 Stearns et al.
6,063,008 A 5/2000 McBride et al.
6,063,009 A 5/2000 Stearns et al.
6,077,196 A 6/2000 Eschenbach
6,077,197 A 6/2000 Stearns et al.
6,077,198 A 6/2000 Eschenbach
6,080,086 A 6/2000 Maresh et al.
6,090,013 A 7/2000 Eschenbach
6,090,014 A 7/2000 Eschenbach
6,099,439 A 8/2000 Ryan et al.
6,113,518 A 9/2000 Maresh et al.
6,126,574 A 10/2000 Stearns et al.
6,135,923 A 10/2000 Stearns et al.
6,146,313 A 11/2000 Whan Tong et al.
6,168,552 B1 1/2001 Eschenbach
6,171,215 B1 1/2001 Stearns et al.
6,176,814 B1 1/2001 Ryan et al.
6,196,948 B1 3/2001 Stearns et al.
6,203,474 B1 3/2001 Jones
6,206,804 B1 3/2001 Maresh
6,210,305 B1 4/2001 Eschenbach
6,217,485 B1 4/2001 Maresh
6,217,486 B1 4/2001 Rosenow
6,248,044 B1 6/2001 Stearns et al.
6,248,045 B1 6/2001 Stearns et al.
6,248,046 B1 6/2001 Maresh et al.
6,254,514 B1 7/2001 Maersh et al.
6,277,054 B1 8/2001 Kuo
6,283,895 B1 9/2001 Stearns et al.
6,302,825 B1 10/2001 Stearns et al.
6,302,830 B1 10/2001 Stearns
6,312,362 B1 11/2001 Maresh et al.
6,334,836 B1 1/2002 Technogym
6,338,698 B1 1/2002 Stearns et al.
6,340,340 B1 1/2002 Stearns et al.
6,361,476 B1 3/2002 Eschenbach
6,387,017 B1 5/2002 Maresh
6,390,953 B1 5/2002 Maresh et al.
6,416,442 B1 7/2002 Stearns et al.
6,422,977 B1 7/2002 Eschenbach
6,436,007 B1 8/2002 Eschenbach
6,440,042 B2 8/2002 Eschenbach
6,450,922 B1 9/2002 Henderson et al.
6,450,925 B1 9/2002 Kuo
6,454,682 B1 9/2002 Kuo
6,458,060 B1 10/2002 Watterson et al.
6,461,277 B2 10/2002 Maresh et al.
6,482,130 B1 11/2002 Pasero et al.
6,516,683 B2 2/2003 Sundaresan et al.
6,540,646 B2 4/2003 Stearns et al.
6,544,146 B1 4/2003 Stearns et al.
6,547,701 B1 4/2003 Eschenbach
6,554,750 B2 4/2003 Stearns et al.
6,565,486 B2 5/2003 Stearns et al.
6,569,061 B2 5/2003 Stearns et al.
6,579,210 B1 6/2003 Stearns et al.
6,610,382 B1 8/2003 Kobe et al.
6,612,969 B2 9/2003 Eschenbach
6,620,079 B2 9/2003 Kuo
6,629,909 B1 10/2003 Stearns et al.
6,645,125 B1 11/2003 Stearns et al.
6,672,992 B1 1/2004 Lo et al.
6,689,020 B2 2/2004 Stearns et al.
6,726,600 B2 4/2004 Miller
6,758,115 B2 7/2004 Allen et al.
6,830,538 B2 12/2004 Eschenbach
6,846,272 B2 1/2005 Rosenow et al.
6,905,442 B1 6/2005 Lee et al.
6,991,587 B1 1/2006 Eschenbach
6,997,852 B2 2/2006 Watterson et al.
7,025,711 B2 4/2006 Eschenbach
7,033,305 B1 4/2006 Stearns et al.
7,037,242 B2 5/2006 Lo et al.
7,041,034 B1 5/2006 Stearns et al.
7,052,438 B2 5/2006 Eschenbach
7,060,004 B2 6/2006 Kuo
7,097,591 B2 8/2006 Moon
7,097,592 B2 8/2006 Wang
7,101,316 B2 9/2006 Rosenow et al.
7,131,935 B2 11/2006 Wang
7,153,239 B1 12/2006 Stearns et al.
7,169,088 B2 1/2007 Rodgers, Jr.
7,169,090 B1 1/2007 Maresh
7,264,576 B2 9/2007 Gerschefske et al.
7,270,626 B2 9/2007 Porth
7,270,628 B2 9/2007 Campanaro et al.
7,344,480 B2 3/2008 Maresh et al.
7,361,122 B2 4/2008 Porth
7,435,202 B2 10/2008 Daly et al.
7,448,986 B1 * 11/2008 Porth ..... A63B 22/001 482/52
7,455,624 B2 11/2008 Liao Lai
7,507,186 B2 3/2009 Stearns et al.
7,559,879 B2 7/2009 Anderson et al.
7,670,268 B1 3/2010 Stearns et al.
7,682,290 B2 3/2010 Liao et al.
7,691,035 B2 4/2010 Chen et al.
7,708,669 B2 5/2010 Rodgers, Jr.
7,722,505 B2 5/2010 Liao et al.
7,740,564 B2 6/2010 Shen
7,749,137 B2 7/2010 Watt et al.
7,758,473 B2 7/2010 Lull et al.
7,785,235 B2 8/2010 Lull et al.
7,803,089 B2 9/2010 Roimicher et al.
7,878,949 B2 2/2011 Chen

(56) References Cited

U.S. PATENT DOCUMENTS

| | | | |
|---|---|---|---|
| 7,918,766 | B2 | 4/2011 | Lu et al. |
| 7,931,566 | B1 | 4/2011 | Radke et al. |
| 8,021,274 | B2 | 9/2011 | Anderson et al. |
| 8,079,937 | B2 | 12/2011 | Bedell et al. |
| 8,092,349 | B2 | 1/2012 | Liao et al. |
| 8,133,159 | B2 | 3/2012 | Eschenbach |
| 8,235,873 | B1 | 8/2012 | Stearns et al. |
| 8,272,997 | B2 | 9/2012 | Anderson et al. |
| 8,376,913 | B2 | 2/2013 | Lee et al. |
| 8,403,815 | B2 | 3/2013 | Liao et al. |
| 8,419,598 | B2 | 4/2013 | Dyer et al. |
| 8,449,437 | B1 | 5/2013 | Maresh et al. |
| 8,540,609 | B2 | 9/2013 | Anderson et al. |
| 8,668,627 | B2 | 3/2014 | Eschenbach |
| 8,827,870 | B2 | 9/2014 | Dyer et al. |
| 8,864,631 | B1 | 10/2014 | Stearns et al. |
| 9,038,577 | B1 | 5/2015 | Lankinen |
| 9,039,577 | B2 | 5/2015 | Peng |
| 9,044,640 | B2 | 6/2015 | Lo et al. |
| 9,050,498 | B2 | 6/2015 | Lu et al. |
| 9,126,078 | B2 | 9/2015 | Anderson et al. |
| 9,138,614 | B2 | 9/2015 | Lu et al. |
| 9,283,425 | B2 | 3/2016 | Lu et al. |
| 9,339,684 | B2 | 5/2016 | Liao et al. |
| 9,381,394 | B2 | 7/2016 | Mortensen et al. |
| 9,403,585 | B2 | 8/2016 | Arad |
| 9,586,085 | B2 | 3/2017 | Arnold et al. |
| 9,604,096 | B2 | 3/2017 | Arnold et al. |
| 9,764,187 | B1 | 9/2017 | Stearns et al. |
| 9,808,667 | B2 | 11/2017 | Liao et al. |
| 9,925,412 | B1 | 3/2018 | Lu |
| 10,201,727 | B2 | 2/2019 | Ohrt et al. |
| 10,252,101 | B2 | 4/2019 | Yim et al. |
| 10,369,403 | B2 | 8/2019 | Liao et al. |
| 10,478,665 | B1 | 11/2019 | Daly et al. |
| 10,532,246 | B2 | 1/2020 | Liao et al. |
| 10,543,396 | B2 | 1/2020 | Yim et al. |
| 10,561,891 | B2 | 2/2020 | Luger et al. |
| 10,653,914 | B2 | 5/2020 | Ellis et al. |
| 10,654,914 | B2 | 5/2020 | Abend et al. |
| 10,946,238 | B1 | 3/2021 | Rogus |
| 2001/0051562 | A1 | 12/2001 | Stearns et al. |
| 2002/0019298 | A1 | 2/2002 | Eschenbach |
| 2002/0032104 | A1 | 3/2002 | Rosenow et al. |
| 2002/0055420 | A1 | 5/2002 | Stearns et al. |
| 2002/0077220 | A1 | 6/2002 | Kuo |
| 2002/0094914 | A1 | 7/2002 | Maresh et al. |
| 2002/0119867 | A1 | 8/2002 | Stearns et al. |
| 2002/0142890 | A1 | 10/2002 | Ohrt et al. |
| 2002/0151411 | A1 | 10/2002 | Stearns et al. |
| 2002/0198084 | A1 | 12/2002 | Stearns et al. |
| 2003/0027690 | A1 | 2/2003 | Miller |
| 2003/0045401 | A1 | 3/2003 | Watterson et al. |
| 2004/0097339 | A1 | 5/2004 | Moon |
| 2004/0209741 | A1 | 10/2004 | Kuo |
| 2005/0028660 | A1 | 2/2005 | Chin-Chin |
| 2005/0043148 | A1 | 2/2005 | Maresh |
| 2005/0049118 | A1 | 3/2005 | Rosenow et al. |
| 2005/0085344 | A1 | 4/2005 | Eschenbach |
| 2005/0124466 | A1 | 6/2005 | Rodgers |
| 2005/0164837 | A1 | 7/2005 | Anderson et al. |
| 2005/0181911 | A1 | 8/2005 | Porth |
| 2005/0209056 | A1 | 9/2005 | Daly et al. |
| 2005/0245361 | A1 | 11/2005 | Wu et al. |
| 2006/0189446 | A1 | 8/2006 | Rogus |
| 2006/0247103 | A1 | 11/2006 | Stearns et al. |
| 2006/0281604 | A1 | 12/2006 | Stewart |
| 2007/0032350 | A1 | 2/2007 | Alessandri et al. |
| 2007/0037666 | A1 | 2/2007 | Gagnon et al. |
| 2007/0087903 | A1 | 4/2007 | Lee et al. |
| 2007/0117683 | A1 | 5/2007 | Ercanbrack et al. |
| 2007/0179023 | A1 | 8/2007 | Dyer |
| 2007/0238582 | A1 | 10/2007 | Lee |
| 2007/0298936 | A1 | 12/2007 | Ohrt et al. |
| 2008/0051258 | A1 | 2/2008 | Schmehl et al. |
| 2008/0200314 | A1 | 8/2008 | Dalebout |
| 2008/0280731 | A1 | 11/2008 | Dalebout |
| 2008/0280735 | A1 | 11/2008 | Dickie |
| 2008/0300114 | A1 | 12/2008 | Dalebout |
| 2009/0291809 | A1 | 11/2009 | Chen |
| 2010/0167877 | A1 | 7/2010 | Grind |
| 2010/0248899 | A1 | 9/2010 | Bedell et al. |
| 2010/0317492 | A1 | 12/2010 | Nelson |
| 2012/0190507 | A1 | 7/2012 | Murray |
| 2013/0210585 | A1 | 8/2013 | Arnold |
| 2013/0310225 | A1 | 11/2013 | Johnson |
| 2014/0194254 | A1 | 7/2014 | Huang |
| 2014/0309086 | A1* | 10/2014 | Chuang ..... A63B 22/0015 482/57 |
| 2015/0087481 | A1 | 3/2015 | Liu |
| 2015/0238807 | A1 | 8/2015 | Long |
| 2015/0343262 | A1 | 12/2015 | Su |
| 2016/0158595 | A1 | 6/2016 | Dalebout |
| 2016/0339295 | A1 | 11/2016 | Lin |
| 2017/0274244 | A1 | 9/2017 | Chang et al. |
| 2018/0036582 | A1 | 2/2018 | Liao |
| 2018/0111019 | A1 | 4/2018 | Ellis et al. |
| 2020/0346069 | A1 | 11/2020 | Tracy |
| 2021/0275866 | A1 | 9/2021 | Rogus |
| 2023/0025399 | A1 | 1/2023 | Rogus |

OTHER PUBLICATIONS

Office Action issued in U.S. Appl. No. 17/191,923, dated Aug. 25, 2023.

* cited by examiner

EXERCISE MACHINES HAVING ADJUSTABLE ELLIPTICAL STRIDING MOTION

CROSS REFERENCE TO RELATED APPLICATIONS

This application is a continuation of U.S. patent application Ser. No. 17/172,468, filed Feb. 10, 2021, which is a continuation of U.S. patent application Ser. No. 16/042,002, filed Jul. 23, 2018, which application issued as U.S. Pat. No. 10,946,238 on Mar. 16, 2021. Both applications are incorporated herein by reference in entirety.

FIELD

The present invention relates to exercise machines, and particularly to exercise machines that facilitate an elliptical striding motion by a user.

BACKGROUND

The following U.S. Patents are incorporated herein by reference:

U.S. Pat. No. 9,925,412 discloses an exercise device including a linkage assembly that links a driving member to a driven member such that circular rotation of the driving member causes generally equal circular rotation of the driven member. The linkage assembly includes a linking member, a first crank arm that connects the driving member to the linking member such that rotation of the driving member causes motion of the linking member, and a second crank arm that connects the linking member to the driven member such that the motion of the linking member causes rotation of the driven member. At least one additional crank arm connects the linking member at a rotational axis that is laterally offset from a straight line through the first and second crank arm rotational axes.

U.S. Pat. No. 9,283,425 discloses an exercise assembly having a frame and elongated foot pedal members that are each movable along user-defined paths of differing dimensions. Each foot pedal member has a front portion and a rear portion. Footpads are disposed on the rear portion of one of the first and second foot pedal members. Elongated coupler arms have a lower portion and an upper portion that is pivotally connected to the frame. Crank members have a first portion that is pivotally connected to the front portion of one of the first and second foot pedal members and have a second portion that is pivotally connected to the lower portion of one of the first and second coupler arms, such that each crank member is rotatable in a circular path. Elongated rocker arms have a lower portion that is pivotally connected to one of the first and second foot pedal members in between the foot pad and the crank member and have an upper portion that is pivotally connected to the frame.

U.S. Pat. No. 9,138,614 discloses an exercise assembly having elongated first and second rocker arms that pivot with respect to each other in a scissors-like motion about a first pivot axis. A slider has a slider body that slides along a linear axis extending through and perpendicular to the first pivot axis. A linkage pivotally couples the first and second rocker arms to the slider body. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis.

U.S. Pat. Nos. 9,126,078 and 8,272,997 disclose an elliptical step exercise apparatus in which a dynamic link mechanism can be used to vary the stride length of the machine. A control system can also be used to vary stride length as a function of various exercise and operating parameters such as speed and direction as well as varying stride length as a part of a preprogrammed exercise routine such as a hill or interval training program. In addition the control system can use measurements of stride length to optimize operation of the apparatus.

U.S. Pat. No. 7,931,566 discloses an elliptical cross trainer that has a rotating inertial flywheel driven by user-engaged linkage exercising a user. A user-actuated brake engages and stops rotation of the flywheel upon actuation by the user.

U.S. Pat. No. 7,918,766 discloses an exercise apparatus for providing elliptical foot motion that utilizes a first and second rocking links suspended from an upper portion of the apparatus frame permitting at least limited arcuate motion of the lower portions of the links. Foot pedal assemblies are connected to rotating shafts or members located on the lower portion of the links such that the foot pedals will describe a generally elliptical path in response to user foot motion on the pedals.

U.S. Pat. No. 6,846,272 discloses an exercise apparatus having a frame that is adapted for placement on the floor, a pivot axle supported by the frame, a first and second pedal levers, pedals secured to the pedal levers, and arm handles connected for motion with the pedal levers and which can utilize a variety of pedal actuation assemblies for generating elliptical motion of the pedal. The stride length portion of the elliptical motion can be increased automatically as a function of exercise parameters such as speed. In addition, the arm handles can be disconnected manually or automatically from the pedal levers.

U.S. Pat. No. 6,217,486 discloses an exercise apparatus that includes a frame adapted for placement on the floor, a pivot axle supported by the frame, a bent pedal lever, a pedal that is secured to the bent pedal lever and a variety of pedal actuation assemblies. These pedal actuation assemblies include components which cooperate to provide an elliptical path and provide the desired foot flexure and weight distribution on the pedal. Consequently, as the pedal moves in its elliptical path, the angular orientation of the pedal, relative to a fixed, horizontal plane, such as the floor, varies in a manner that simulates a natural heel to toe flexure.

U.S. Pat. Nos. 6,203,474; 6,099,439; and 5,947,872 disclose an exercise apparatus including a frame that is adapted for placement on the floor, a pivot axis supported by the frame, a pedal bar which has first and second ends, a pedal that is secured to the pedal bar, an ellipse generator, and a track. The ellipse generator is secured to both the pivot axis and to the first end of the pedal bar such that the first end of said pedal bar moves in an elliptical path around the pivot axis. The track is secured to the frame and engages the second end of said pedal bar such that the second end moves in a linear reciprocating path as the first end of the pedal bar moves in the elliptical path around said pivot axis. Consequently, the pedal also moves in a generally elliptical path. As the pedal moves in its elliptical path, the angular orientation of the pedal, relative to a fixed, horizontal plane, such as the floor, varies in a manner that simulates a natural heel to toe flexure.

U.S. Pat. No. 5,899,833 discloses an exercise apparatus including a frame, a pivot axis supported by the frame, a pedal lever, a coupler for pivotally coupling a first end of the pedal lever to the pivot axis at a predetermined distance from the pivot axis such that the first end moves in an arcuate pathway around the pivot axis, a guide member supported by the frame and engaging a second end of the pedal lever such that the second end of the pedal lever moves in a reciprocating pathway as the first end of the pedal lever moves in the arcuate pathway, and a pedal having a toe portion and a heel portion, the pedal being pivotally coupled with the second end of the pedal lever such that the toe portion is intermediate the heel portion and the pivot axis and the heel portion is raised above the toe portion when the second end moves in the reciprocating pathway in a direction away from the pivot axis.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain non-limiting examples, an exercise machine is for performing a striding exercise motion. The exercise machine has frame; first and second pedal members; first and second foot pads on the first and second pedal members, respectively, each of the first and second foot pads being configured to move in an elliptical path during the striding exercise motion; first and second rocker arms pivotally coupled to the frame; and first and second adjustment devices configured to actively adjust and set a position of the first and second pedal members relative to the first and second rocker arms, respectively, which thereby changes a shape of the elliptical path. In certain non-limiting examples, first and second crank arms are pivotally coupled to a rear frame portion. First and second rear link arms pivotally couple rear pedal portions to the first and second crank arms, respectively, and thereby facilitate adjustment of the first and second pedal members relative to the first and second crank arms when the position of the first and second pedal members relative to the first and second rocker arms is adjusted.

BRIEF DESCRIPTION OF THE DRAWINGS

The present disclosure is described with reference to the following Figures. The same numbers are used throughout the Figures to reference like features and like components. Unless otherwise specifically noted, articles depicted in the drawings are not necessarily drawn to scale.

DETAILED DESCRIPTION OF THE DRAWINGS

Figure 1:
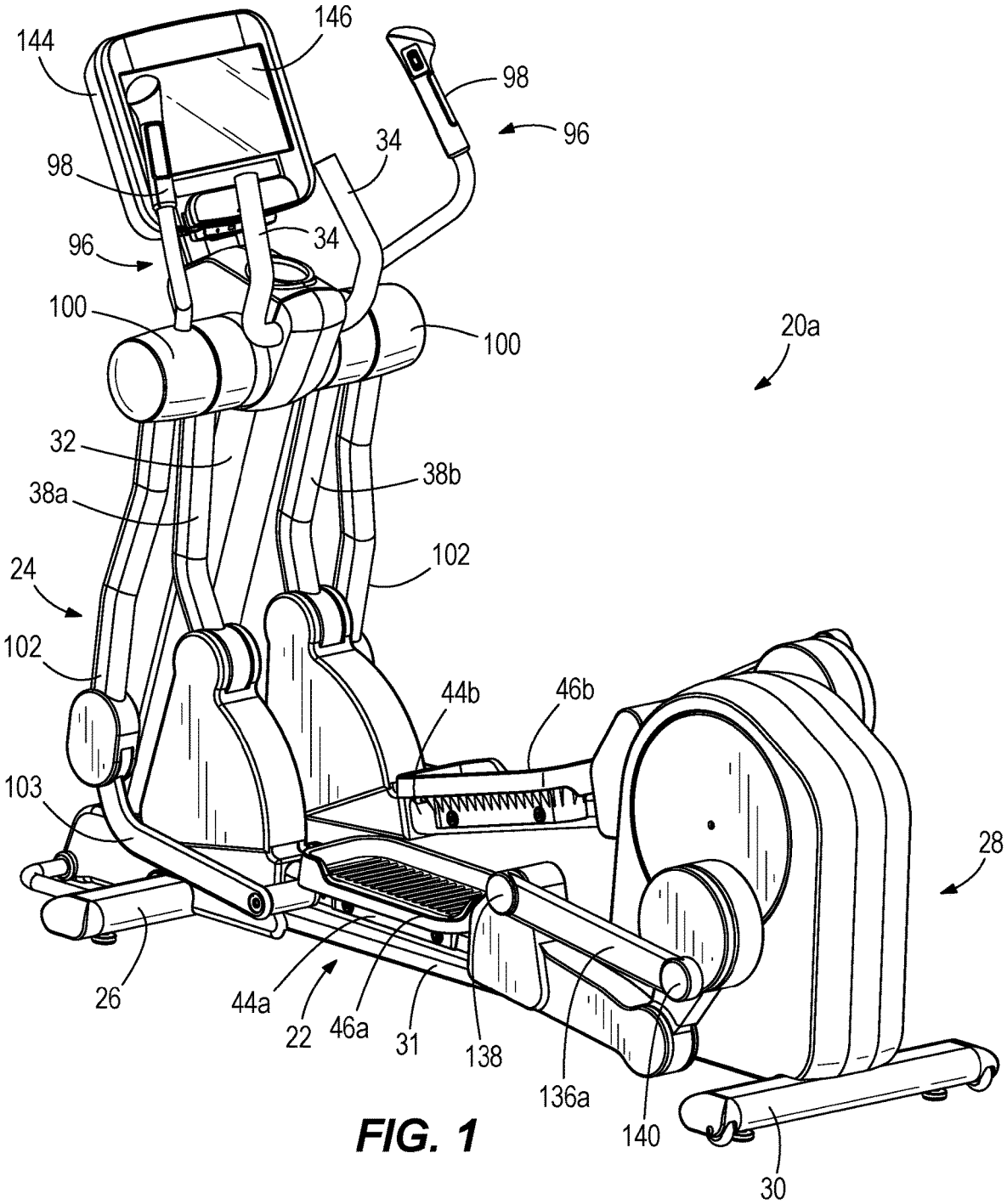
FIG. 1 is a perspective view of a first embodiment of an exercise machine according to the present disclosure.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

During research and development, the present inventor determined that it would be desirable to provide an exercise machine for performing an elliptical striding motion, wherein the user's foot path and/or orientation of the elliptical path travelled by the machine can be adjusted and set based upon the user's preferences and/or based upon a certain exercise routine. The present inventor further determined that it would be desirable to provide such an exercise machine with a robust design that avoids use of tracks or linear rollers/guides, which can be noisy and expensive, and subject to breakdown. The present inventor had determined it would be desirable to design such a machine with a small footprint compared to prior art machines. The present disclosure is a result of these endeavors.

FIG. 1 depicts a first embodiment of an exercise machine 20*a* for performing a striding exercise motion. The exercise machine 20*a* includes a frame 22 having a front frame portion 24 with laterally extending leg braces 26 and a rear frame portion 28 with laterally extending leg braces 30. A base member 31 longitudinally extends from the front frame portion 24 to the rear frame portion 28. A support column 32 vertically upwardly extends from the front frame portion 24 and supports stationary handles 34 for manually grasping by a user performing the striding exercise motion. A stationary shaft 36 (see FIG. 6) laterally extends from the support column 32 at a location proximate to the stationary handles 34. The type and configuration of the frame 22 and stationary handles 34 is merely exemplary and can vary from what is shown.

Figure 2:
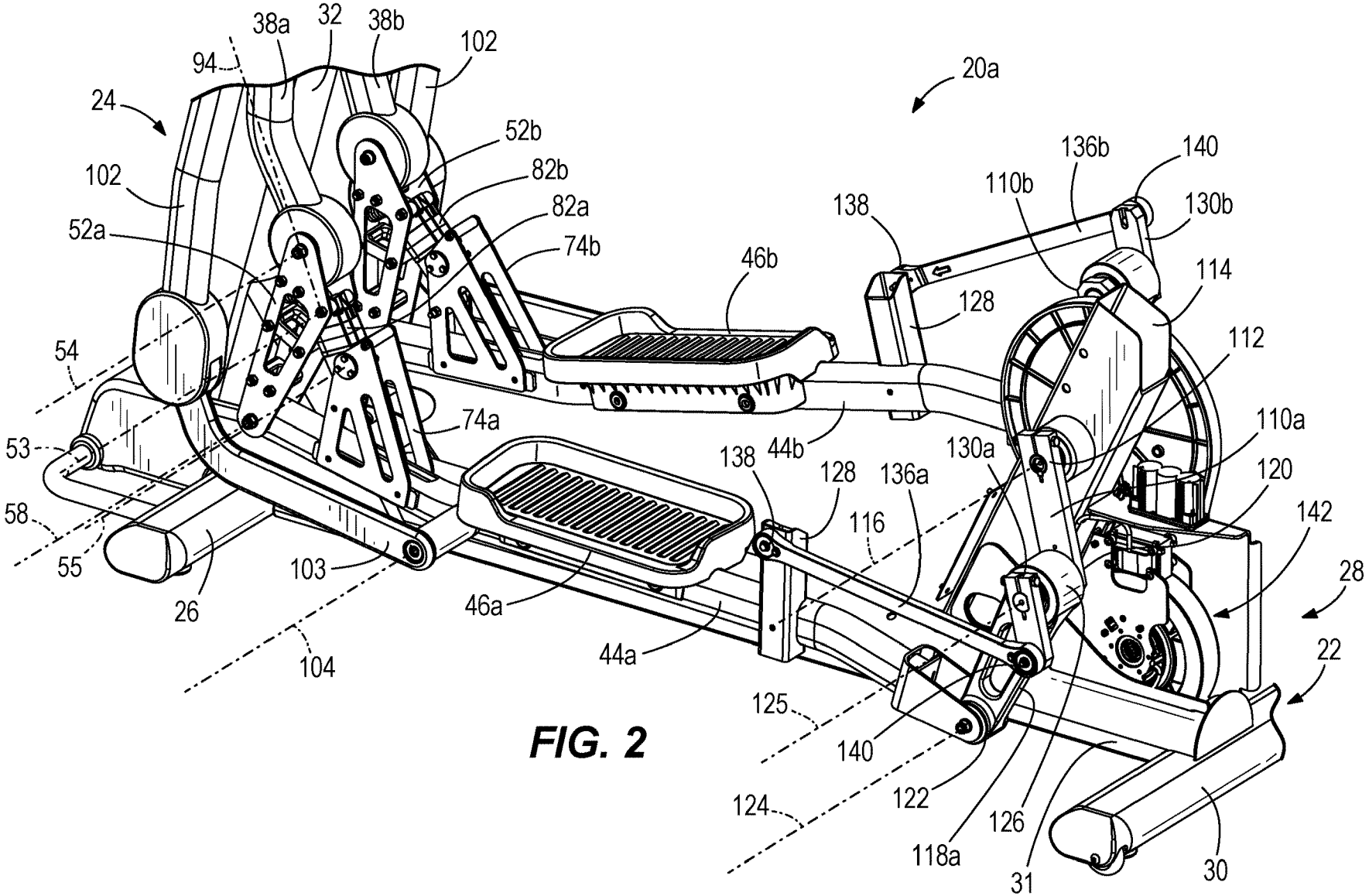
FIG. 2 is a perspective view of a lower portion of the first embodiment having outer shrouds removed.

Referring to FIGS. 1 and 2, first and second rocker arms 38*a*, 38*b* have upper ends that are attached to and pivotally depend from opposite sides of the stationary shaft 36 relative to the support column 32. The upper ends have bearings that are journaled about the stationary shaft 36 and configured so that the rocker arms 38*a*, 38*b* can rotate back and forth with respect to the stationary shaft 36 as the user performs the striding exercise motion. The exercise machine 20*a* further has first and second pedal members 44*a*, 44*b* that longitudinally extend with respect to the frame 22. The pedal members 44*a*, 44*b* support first and second foot pads 46*a*, 46*b* that support the user's feet during the striding exercise motion. The type and configuration of the foot pads 46*a*, 46*b* can vary from what is shown. Examples of suitable foot pads are fully described in commonly-owned U.S. patent application Ser. No. 15/693,724, filed Sep. 1, 2017. In general, the foot pads 46*a*, 46*b* include a tread surface for engagement by the user's feet and a base frame that supports the tread surface with respect to the respective pedal members 44*a*, 44*b*. Generally, as will be further described herein below, the exercise machine 20*a* is configured such that the foot pads 46*a*, 46*b* and the corresponding user's feet move in an elliptical path during the striding exercise motion. The exercise machine 20*a* is further configured so that the user and/or a controller associated with the machine 20*a* can actively vary the shape of the elliptical path, as will be further described with reference to FIGS. 4-6.

Figure 3:
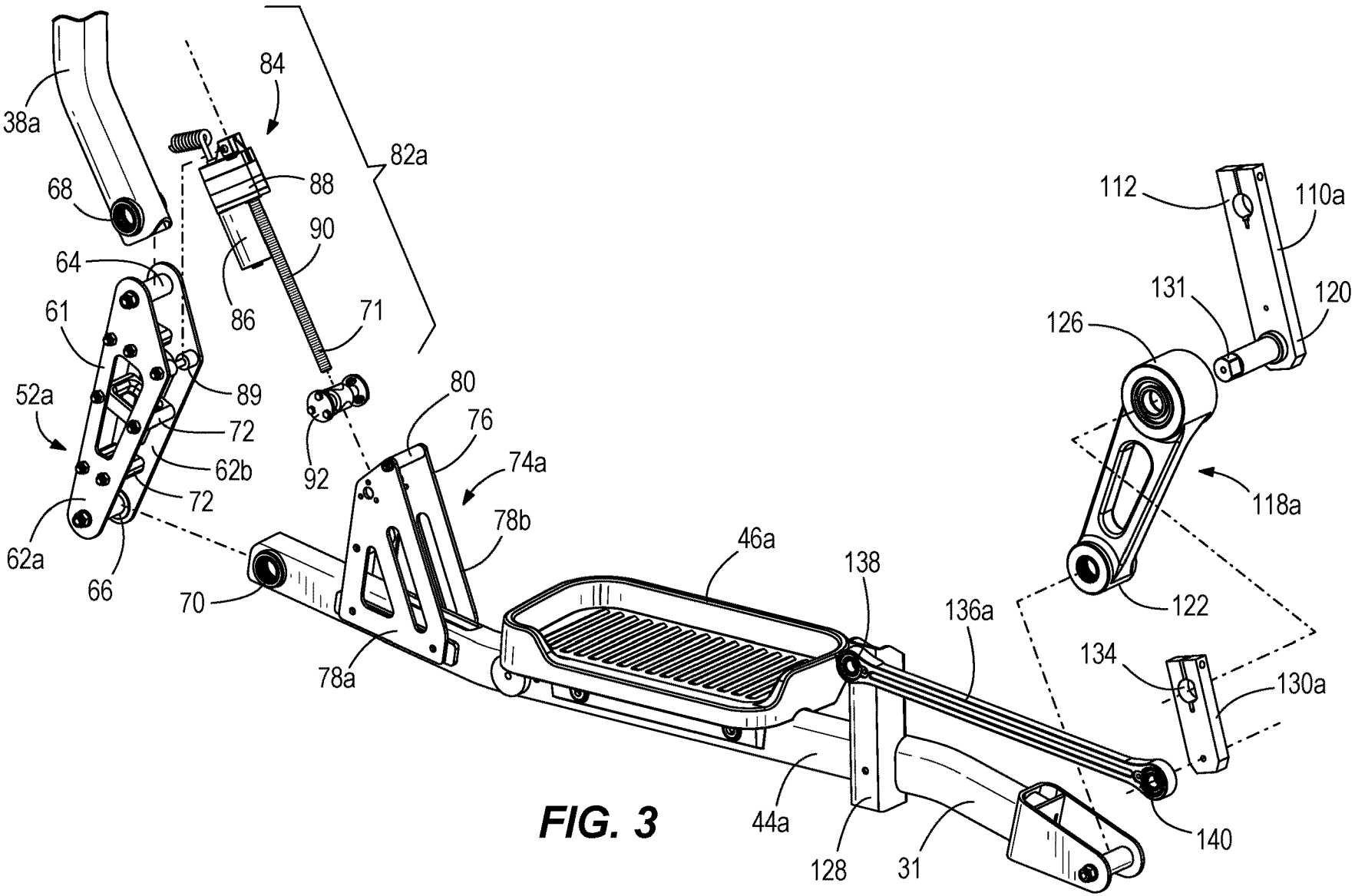
FIG. 3 is an exploded view of portions of the first embodiment.

Referring to FIGS. 2 and 3, first and second front link arms 52*a*, 52*b* are pivotally coupled at a first pivot axis 54 to a lower portion of a respective one of the rocker arms 38*a*, 38*b*, and pivotally coupled at a second pivot axis 58 to a forward portion of a respective one of the pedal members 44*a*, 44*b*. In the illustrated example, the front link arms 52*a*, 52*b* each include a frame member 61 having opposing sides 62*a*, 62*b* and top and bottom pivot pins 64, 66 that extend through cross bores 68, 70 in the respective one of the rocker arms 38*a*, 38*b* and the respective one of the pedal members 44*a*, 44*b*. Additional supporting ribs 72 extend between the opposing sides 62*a*, 62*b* of the frame member 61. The front link arms 52*a*, 52*b* can be a casting, weldment, and/or the like. The configuration of the front link arms 52*a*, 52*b* can vary from what is shown, as will be evident from the description herein below regarding the third embodiment.

With continued reference to FIGS. 2 and 3, first and second supporting brackets 74*a*, 74*b* extend upwardly from the forward portion of the respective pedal members 44*a*, 44*b*. In the illustrated example, the supporting brackets 74*a*, 74*b* each include a frame member 76 having opposing sides 78*a*, 78*b* coupled to the corresponding pedal members 44*a*, 44*b*. A rib 80 extends between the sides 78*a*, 78*b* and provides stability.

With continued reference to FIGS. 2 and 3, first and second adjustment devices 82*a*, 82*b* are specially configured to adjust and set the position of the pedal members 44*a*, 44*b* relative to the rocker arms 38*a*, 38*b*, respectively, which as explained further herein below changes a shape of the above-noted elliptical path. More particularly, the first and second adjustment devices 82*a*, 82*b* are specially configured to adjust and set the position of the first pivot axis 54 relative to the pedal members 44*a*, 44*b*. In the illustrated embodiment, each of the adjustment devices 82*a*, 82*b* includes a linear actuator 84 that is extendable and retractable, which as explained further herein below with reference to FIGS. 4-6 thereby adjusts the relative position of the first and second pivot axes 54, 58. The linear actuator 84 includes a conventional bi-directional electric motor 86 mounted to a gearbox 88. The gearbox 88 is pivotally coupled to a respective front link arm 52*a*, 52*b* at a pivot pin 89 extending between the sides 62*a*, 62*b* of the frame member 61. Thus, each of the adjustment devices 82*a*, 82*b* are coupled to the respective front link arms 52*a*, 52*b* at a respective first adjustment device pivot axis 53 (see FIG. 2). The type and configuration of the linear actuator 84 can vary from what is shown and described. In other examples, the linear actuator 84 could include a worm gear with a right-angle motor.

The gearbox 88 contains a gear set (not shown) that connect an output shaft (not shown) of the electric motor 86 to a first end portion of a positioning screw 90, which is disposed in the gearbox 88. Operation of the electric motor 86 causes rotation of the motor output shaft, which in turn operates the gear set, which in turn causes rotation of the positioning screw 90. A second end portion 71 of the positioning screw 90 is engaged via a threaded engagement with an engagement nut 92 that is pivotally mounted within the respective first or second supporting brackets 74*a*, 74*b*. Thus, each adjustment device 82*a*, 82*b* is coupled to a respective one of the pedal members 44*a*, 44*b* at a second adjustment device pivot axis 55 (see FIG. 2), which is located above and rearwardly of the second pivot axis 58. The adjustment device pivot axes 53, 55 are located vertically between the first and second pivot axes 54, 58. Each of the adjustment devices 82*a*, 82*b* extends along a respective adjustment device axis 94 (see FIG. 2), which in this example exactly and/or nearly intersects with the first pivot axis 54. This can vary from what is shown, as will be evident from description of the second embodiment shown in FIGS. 7-10 hereinafter below.

With continued reference to FIGS. 2 and 3, operation of the electric motor 86 in a first direction causes rotation of the positioning screw 90 about its own axis in a first direction and operation of the electric motor 86 in an opposite direction causes opposite rotation of the positioning screw 90 about its own axis in an opposite, second direction. Rotation of the positioning screw 90 in the first direction causes the positioning screw 90 to travel outwardly relative to the engagement nut 92, thus lengthening the linear actuator 84. Rotation of the positioning screw 90 in the second direction causes the positioning screw 90 to travel further into engagement with the engagement nut 92, thus shortening the linear actuator 84.

Figure 4:
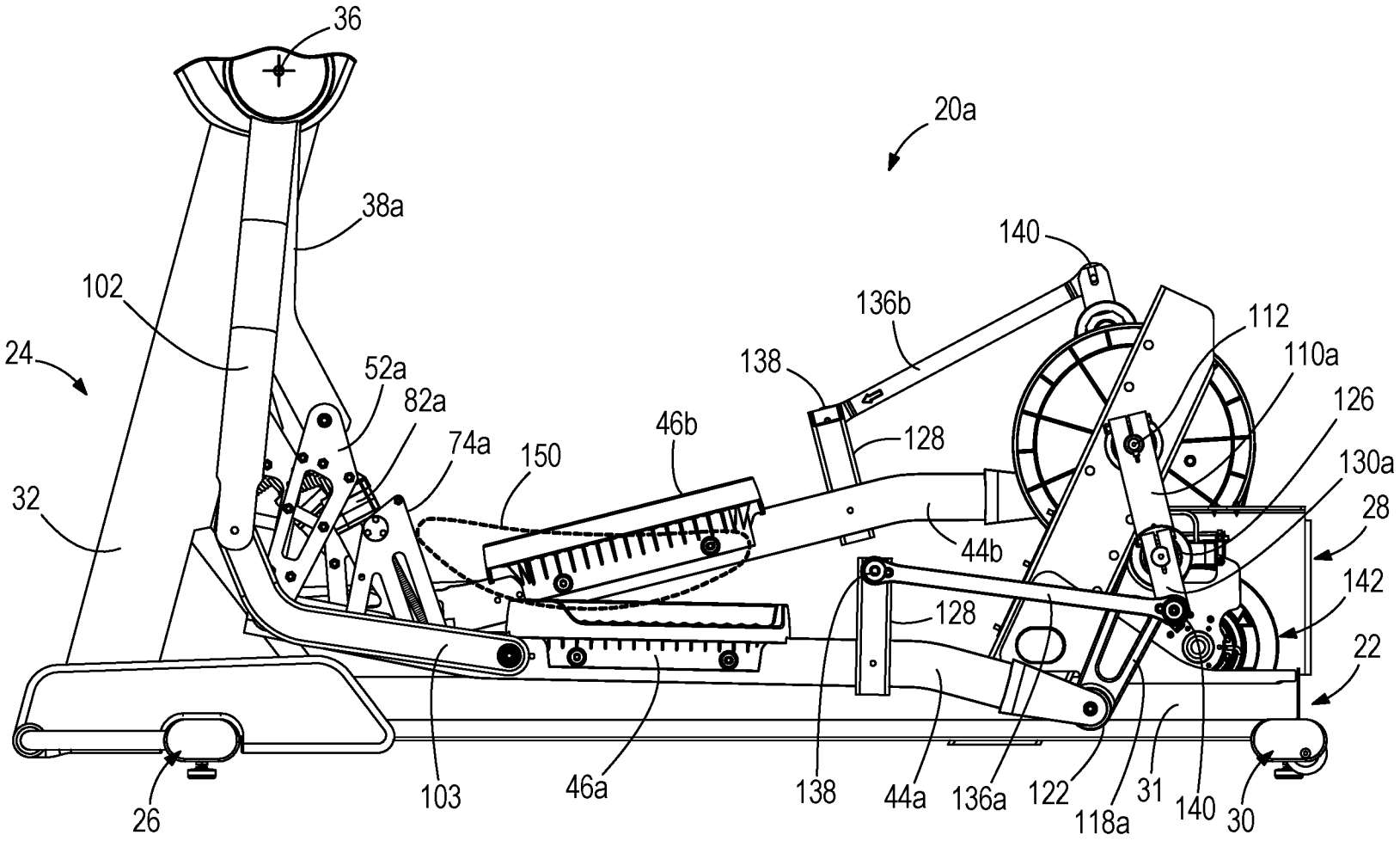
FIG. 4 is a side view of the first embodiment, showing an elliptical path of a foot pad when adjustment devices on the foot pedal members are retracted.
Figure 5:
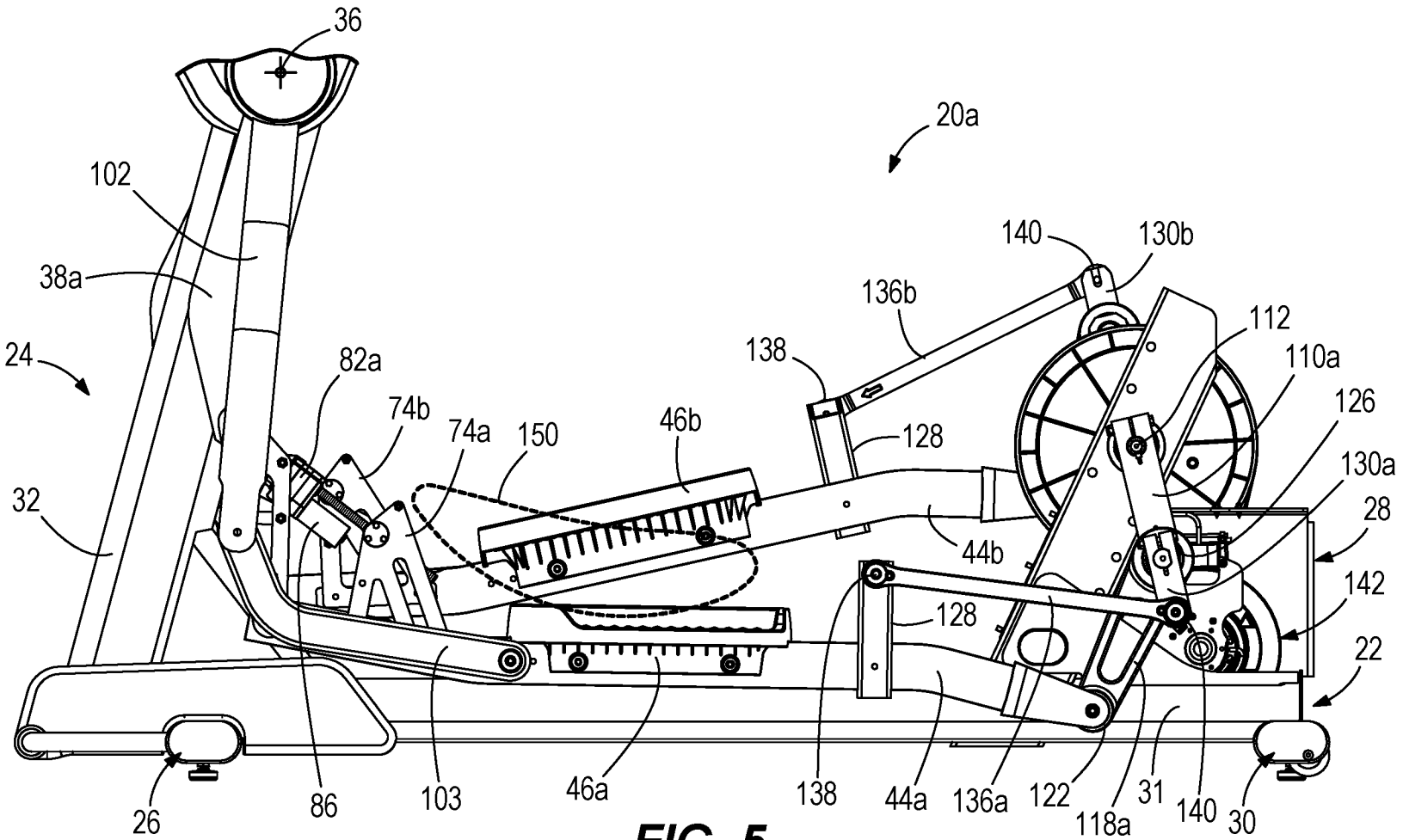
FIG. 5 is a view like FIG. 4, showing the elliptical path when the adjustment devices are partially extended.
Figure 6:
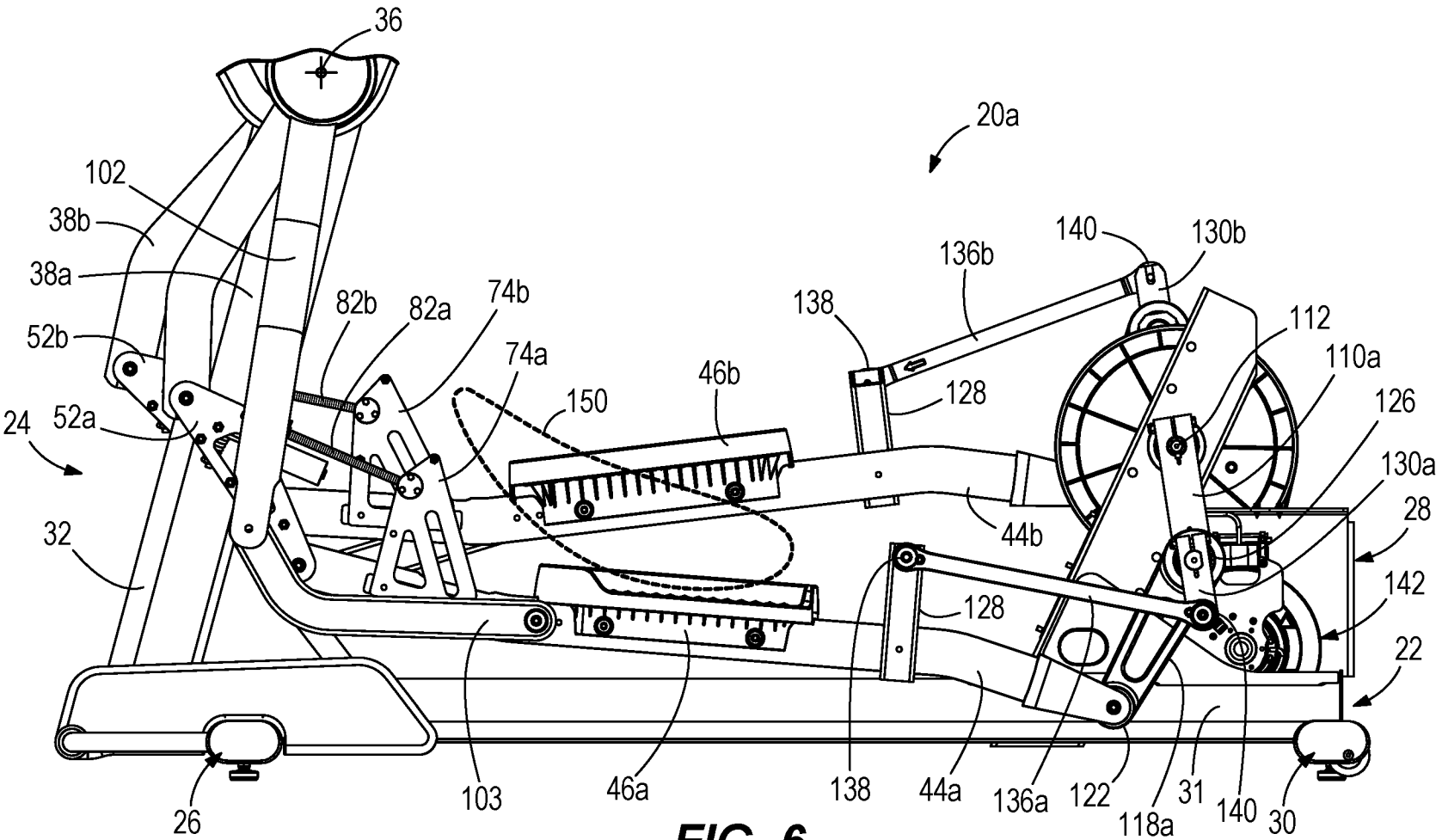
FIG. 6 is a view like FIG. 4, showing the elliptical path when the adjustment devices are fully extended.
Figure 7:
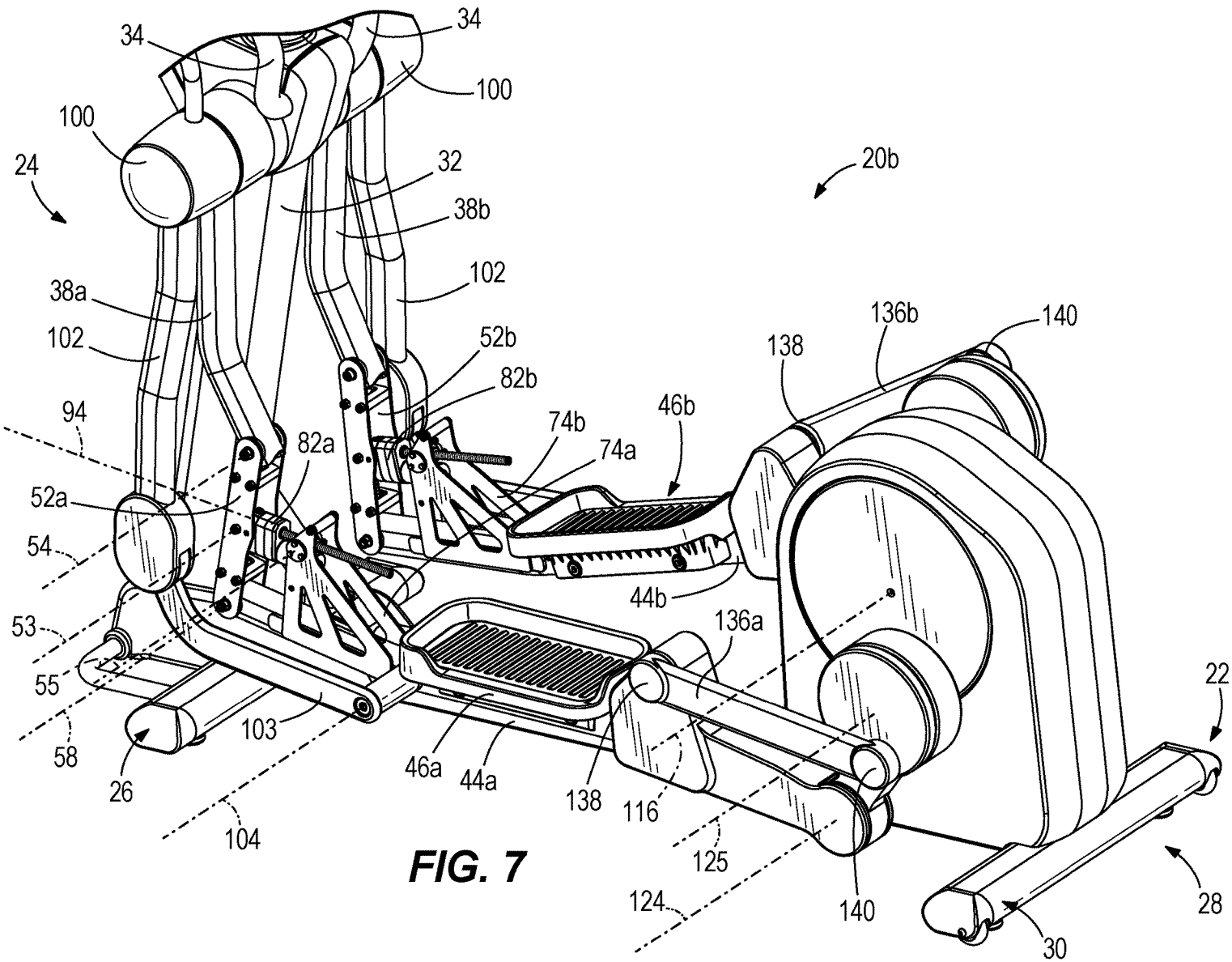
FIG. 7 is a perspective view of a second embodiment of an exercise machine according to the present disclosure.
Figure 8:
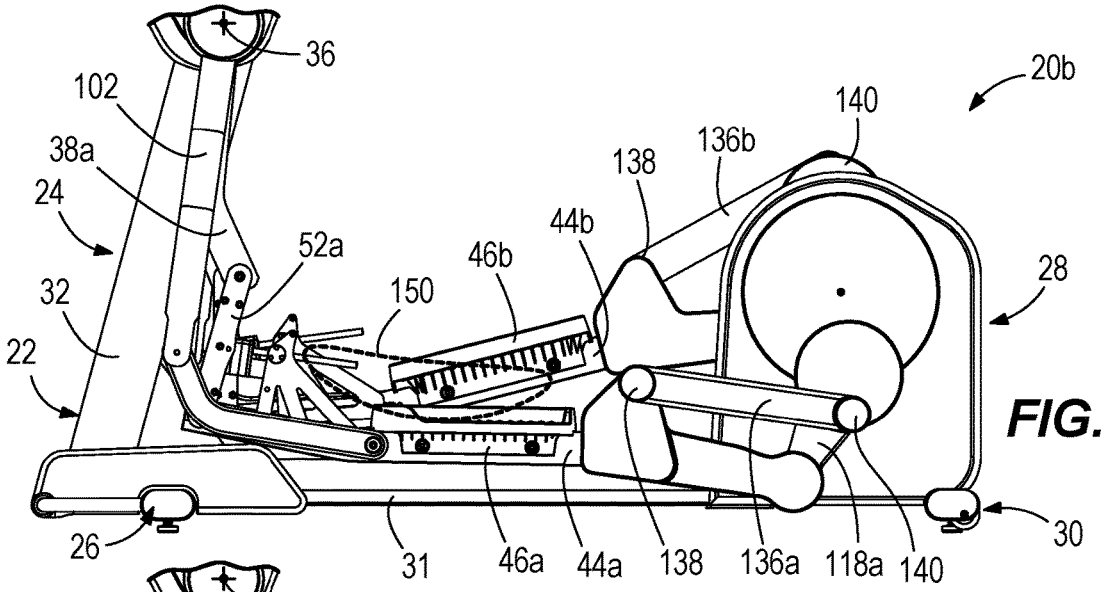
FIG. 8 is a side view of the second embodiment, showing an elliptical path of a foot pad when the adjustment devices on the foot pedal members are retracted.
Figure 9:
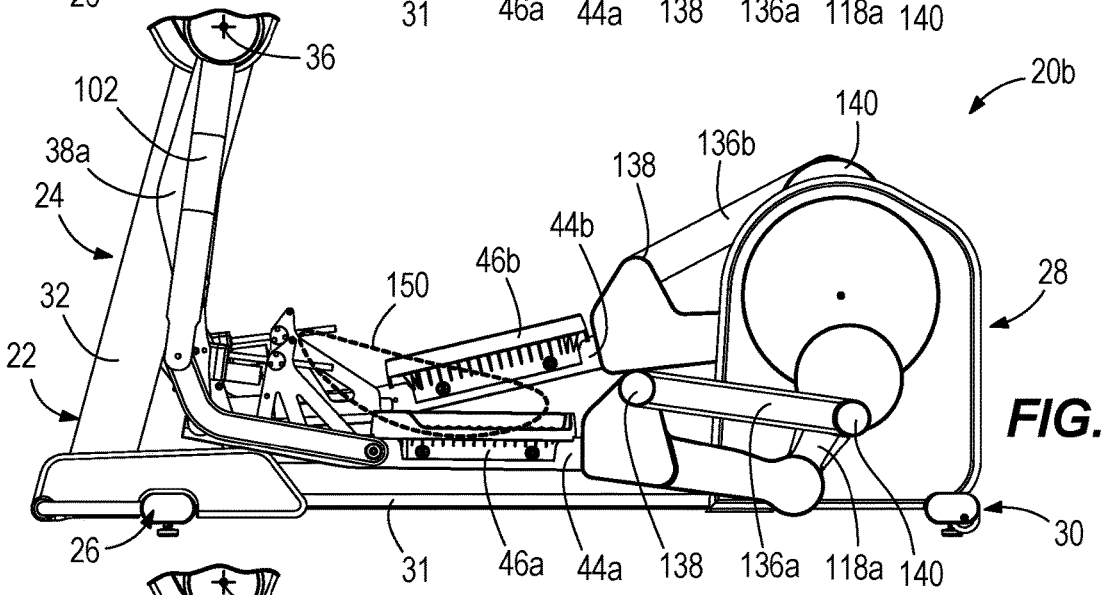
FIG. 9 is a view like FIG. 8, showing the elliptical path when the adjustment devices are partially extended.
Figure 10:
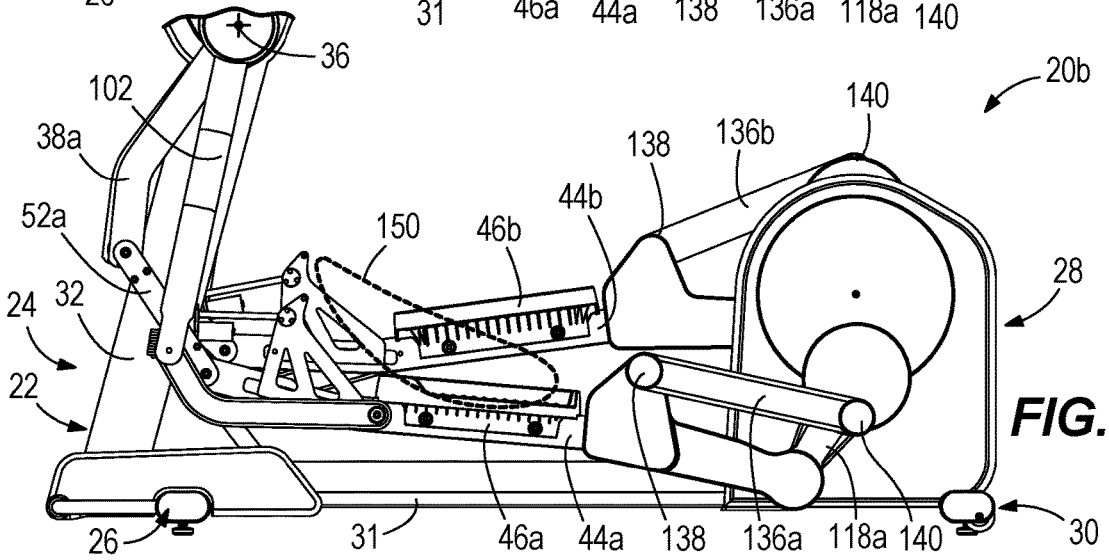
FIG. 10 is a view like FIG. 8, showing the elliptical path when the adjustment devices are fully extended.
Figure 11:
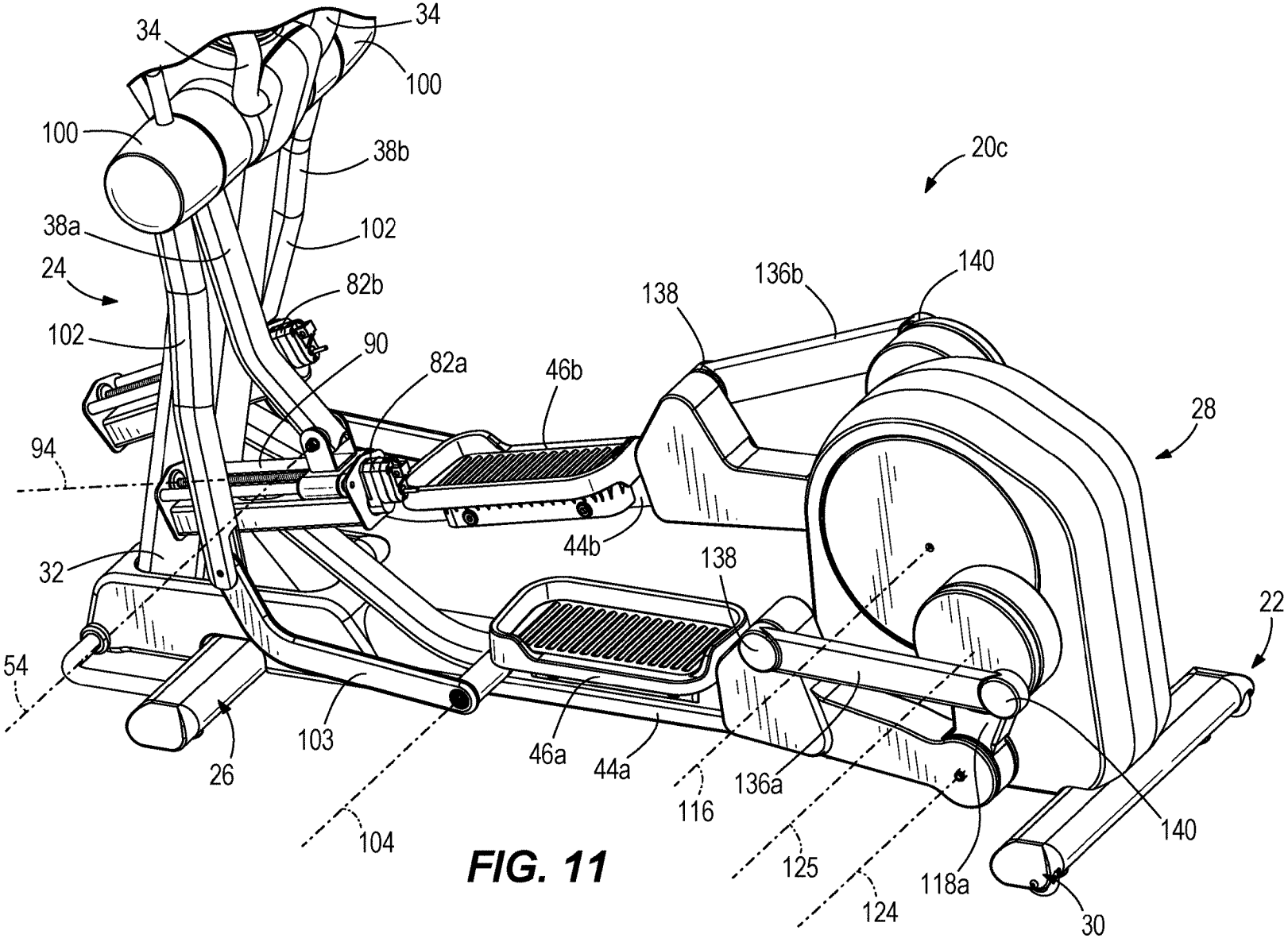
FIG. 11 is a perspective view of a third embodiment of an exercise machine according to the present disclosure.
Figure 12:
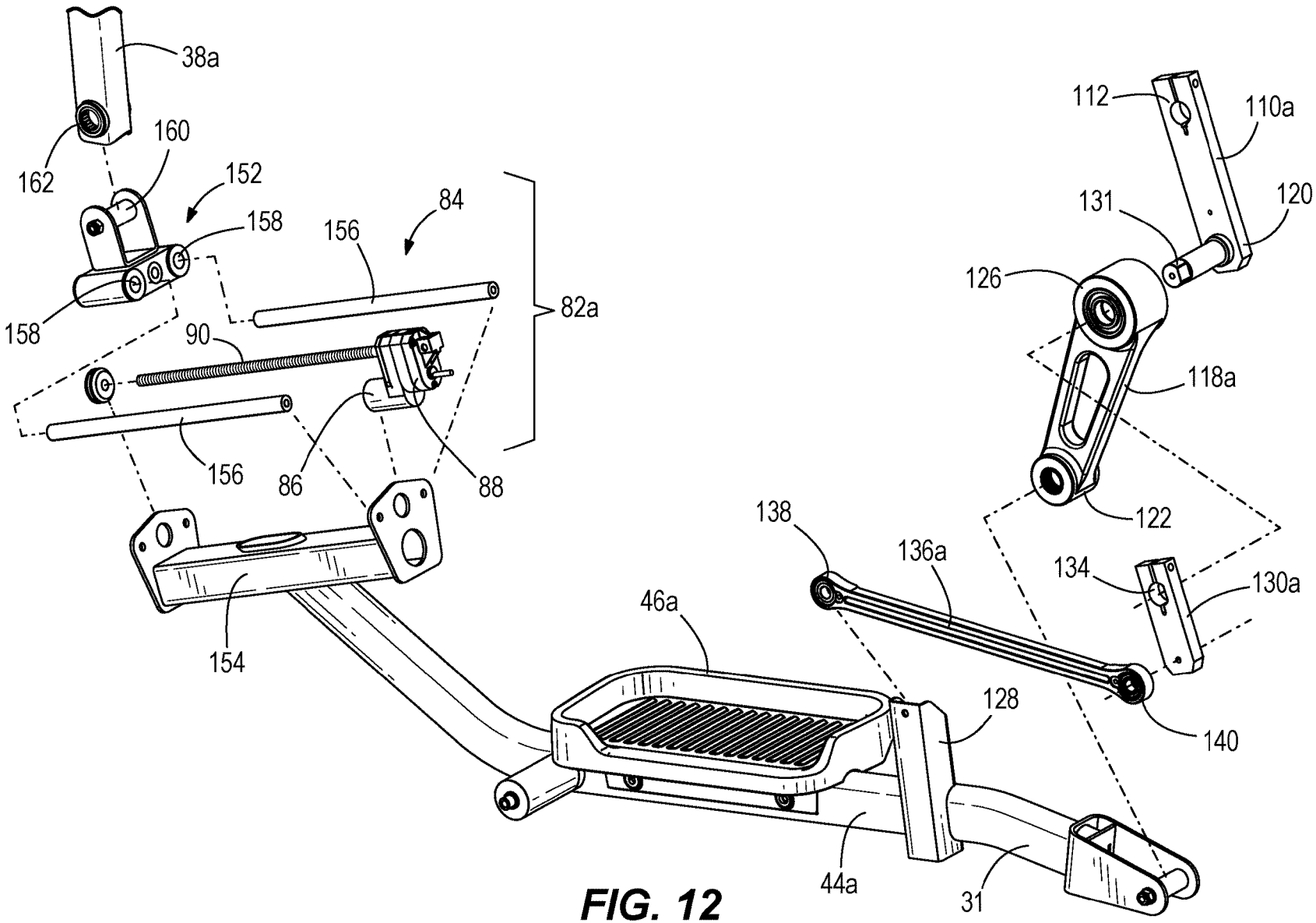
FIG. 12 is an exploded view of portions of the third embodiment.

Referring to FIGS. 1 and 2, the exercise machine 20*a* further includes first and second handle members 96 that are configured for manual engagement during the striding exercise motion. The first and second handle members 96 are pivotally coupled to the frame 22 along the stationary shaft 36 and have upper handle portions 98 that extend upwardly from the stationary shaft 36 from respective pivot bearings 100 journaled on and pivotable about the stationary shaft 36. In this way, the upper handle portions 98 are pivotable forwardly and rearwardly with respect to the stationary shaft 36 during the striding exercise motion. The handle members 96 each have a lower end portion 102 that is pivotally coupled to an L-shaped connecting link 103, which in turn is coupled to a corresponding front portion of one of the pedal members 44*a*, 44*b*, and more specifically along a handle member pivot axis 104 (see FIG. 2) that is located rearwardly of the second pivot axis 58. By coupling to the first and second pedal members 44*a*, 44*b*, the range of motion of the handle members 96 is virtually unaffected by changing the elliptical path 150 (FIGS. 4-6). In other words, adjustment of the position of the pivot axis 54 relative to the respective pedal member 44*a*, 44*b* via the adjustment device 82*a*, 82*b* changes the shape of the ellipse 150, but not the arc or range of motion of the handle members 96. The shape and configuration of the connecting link 103 can vary from what is shown.

Referring now to FIGS. 2, 3, 6, 15 and 16, the rear frame portion 28 supports the rear portions of the respective pedal members 44*a*, 44*b*. Specifically, first and second crank arms 110*a*, 110*b* each have a first end portion 112 that is pivotally coupled to a stanchion 114 that upwardly extends on the rear frame portion 28. The crank arms 110*a*, 110*b* are keyed together so that they remain 180 degrees apart from each other during operation of the exercise machine 20*a*. The first end portions 112 of the crank arms 110*a*, 110*b* are coupled together along a common crank axis 116. First and second rear link arms 118*a*, 118*b* pivotally couple the crank arms 110*a*, 110*b* to the rear portions of the respective pedal members 44*a*, 44*b*. As further explained herein below, the rear link arms 118*a*, 118*b* facilitate adjustment of the pedal members 44*a*, 44*b* relative to the crank arms 110*a*, 110*b* when the position of the pedal members 44*a*, 44*b* relative to the rocker arms 38*a*, 38*b* is adjusted via the adjustment devices 82*a*, 82*b*. The crank arms 110*a*, 110*b* each have a second end portion 120 that is pivotally coupled to a respective one of the rear link arms 118*a*, 118*b*. The rear link arms 118*a*, 118*b* each have a first end portion 122 that is pivotally coupled to the rear portion of the pedal members 44*a*, 44*b* at a pedal-link arm pivot axis 124, and a second end portion 126 that is pivotally coupled to the first and second crank arms 110*a*, 110*b* along a pedal-crank pivot axis 125. In this example, the pedal-link arm pivot axis 124 is located vertically below the common crank axis 116 so that the rear link arms 118*a*, 118*b* are subjected to tension forces from the weight of the user standing on the foot pads 46*a*, 46*b*; however this can vary, as will be evident from the alternate embodiment described herein below with respect to FIGS. 16 and 17.

With continued reference to FIGS. 2, 3, 6, 15 and 16, first and second crank extensions 130*a*, 130*b* axially extend from the second end portions 120 of the crank arms 110*a*, 110*b*, respectively. The crank extensions 130*a*, 130*b* are coupled to the crank arms 110*a*, 110*b* via a keyed shaft 131 on the respective crank arms 110*a*, 110*b* and a corresponding slotted keyhole 134 formed in the crank extensions 130*a*, 130*b*. Thus, the crank extensions 130*a*, 130*b* rotate with and remain parallel with the crank arms 110*a*, 110*b*, as the crank arms 110*a*, 110*b* are rotated about the common crank axis 116.

The rear portions of the pedal members 44*a*, 44*b* each have an upwardly-extending extension member 128 that extends transversely upwardly relative to the respective pedal member 44*a*, 44*b*. First and second guide members 136*a*, 136*b* each have a first guide end portion 138 pivotally coupled to the extension member 128 on a respective rear portion of the respective pedal member 44*a*, 44*b* and a second guide end portion 140 pivotally coupled to a respective one of the crank extensions 130*a*, 130*b*. A conventional resistance mechanism 142 (e.g., hybrid generator-brake) is mounted to the frame 22 at the rear frame portion 28 and coupled to the crank arms 110*a*, 110*b* so as to provide resistance to rotation of the crank arms 110*a*, 110*b* about the common crank axis 116 and optionally generating power based upon the rotation for powering, for example, the electric motor 86. The resistance mechanism 142 is a conventional item and thus is not further described herein for the sake of brevity. A suitable resistance mechanism 142 is the FB 6 Series sold by Chi Hua.

Referring to FIG. 1, the exercise machine 20*a* further includes a controller 144 that is configured to control the adjustment devices 82*a*, 82*b* so as to actively adjust the shape of the elliptical path. Optionally, the controller 144 can be powered by the resistance mechanism 142, and/or a battery, and/or another electric power source. In the illustrated example, the controller 144 is configured to control the electric motor 86 and particularly to cause the electric motor 86 to operate and cause rotation of the positioning screw 90, as described herein above. The controller 144 can include a programmable processor, a memory, and an input/output device. The processor is communicatively connected to a computer readable medium that includes volatile or nonvolatile memory upon which computer readable code is stored. The processor can access the computer readable code on the computer readable medium, and upon executing the code, can send signals to carry out functions according to the methods described herein below. In the illustrated example, execution of the code allows the controller 144 to control (e.g. actuate) the electric motor 86.

The exercise machine 20*a* further includes a user input device 146. Optionally, the user input device 146 can be powered by the resistance mechanism 142, and/or a battery, and/or another electric power source. The type and configuration of the user input device 146 can vary from what is shown. In the illustrated example, the user input device 146 mounted on the frame 22 and vertically extends above the stationary handles 34 so that a user standing on the foot pads 46*a*, 46*b* can view and manually actuate the user input device 146. In this example, the user input device 146 includes a touch screen that displays operating characteristics of the exercise machine 20*a* and allows the user to manually input commands to the controller 144, in particularly to command the controller 144 to actuate the adjustment devices 82*a*, 82*b* via the electric motor 86. This allows the user to actively adjust the shape of the noted elliptical path of travel of the foot pads 46*a*, 46*b*, as further described herein below.

FIGS. 4-6 depict operation of the exercise machine 20*a* in positions of use, in which the adjustment devices 82*a*, 82*b* are retracted (FIG. 4), partially extended (FIG. 5) and fully extended (FIG. 6). In each position, the elliptical path 150 traveled by the foot pads 46*a*, 46*b* has the same horizontal length. As shown in the Figures, the adjustment devices 82*a*, 82*b* advantageously facilitate infinite adjustment of footpath (ellipse) inclination and/or orientation and/or angle. This can be accomplished without the use of ramps or guides. The horizontal length (i.e. the axial length from front to back with respect to the exercise machine 20) of the elliptical path 150 traveled by the foot pads 46*a*, 46*b* remains constant before and after operation of the adjustment devices 82*a*, 82*b*; however in each position of the adjustment devices 82*a*, 82*b*, the shape of the elliptical path 150 is different. In particular, the adjustment devices 82*a*, 82*b* facilitate adjustment and setting of the location of the pedal members 44*a*, 44*b* relative to the rocker arms 38*a*, 38*b*. As these relative positions are changed, so does the vertical displacement of the first pivot axis 54 and second pivot axis 58, which changes shape of the elliptical path 150 along which the foot pads 46*a*, 46*b* move.

As described herein above, the controller 144 can be actuated by the user via the user input device 146 to thereby actively adjust and set the adjustment devices 82*a*, 82*b* to thereby change the shape of the elliptical path 150. Optionally, the controller 144 can also or alternately be programmed to automatically change the elliptical path 150 depending upon an operational or other characteristic of the exercise machine 20*a* and/or an exercise routine saved in the memory of the controller 144. In some examples, changes to the elliptical path 150 can occur before the exercise routine begins. In some examples, changes to the elliptical path 150 can occur during the exercise routine or after the exercise routine ends.

As shown in FIGS. 4-6, actively adjusting the adjustment devices 82*a*, 82*b* actively adjusts and sets a relative position of the first and second pivot axes 54, 58. Stated another way, actively adjusting the adjustment devices 82*a*, 82*b* actively changes an angle at which the front link arms 52*a*, 52*b* extend between the first and second adjustment device pivot axes 53*a*, 53*b*. Changing this angle also causes a change in a fore-aft range of motion through which each of the rocker arms 38*a*, 38*b* pivot with respect to the frame 22 during the striding exercise motion. As described above, adjustment of the position of the pedal members 44*a*, 44*b* relative to the rocker arms 38*a*, 38*b* is facilitated at the rear frame portion 28 by pivoting of the rear link arms 118*a*, 118*b*—without the need for linear guides or other similar bearings. More specifically, the rear link arms 118*a*, 118*b* are pivotally coupled to the pedal members 44*a*, 44*b* and thus adjustment of the position of the pedal members 44*a*, 44*b* is accommodated by pivoting of the rear link arms 118*a*, 118*b* about the respective pedal-link arm axis 124 and pedal-crank pivot axis 125.

FIGS. 7-10 depict a second embodiment of the exercise machine 20*b*, in which the adjustment devices 82*a*, 82*b* each extend along respective adjustment device axis 94 that intersects with the respective front link arm 52*a*, 52*b* between the first and second pivot axes 54, 58. Like reference numbers are applied in accordance with the description herein above regarding the first embodiment. Due to the orientation of the adjustment device axis 94, the second embodiment of the exercise machine 20*b* places more load on the linear actuator 84; however it requires less travel length for the linear actuator 84 to enact a change in the shape of the elliptical path 150 compared to the first embodiment of the exercise machine 20*a*.

Figure 13:
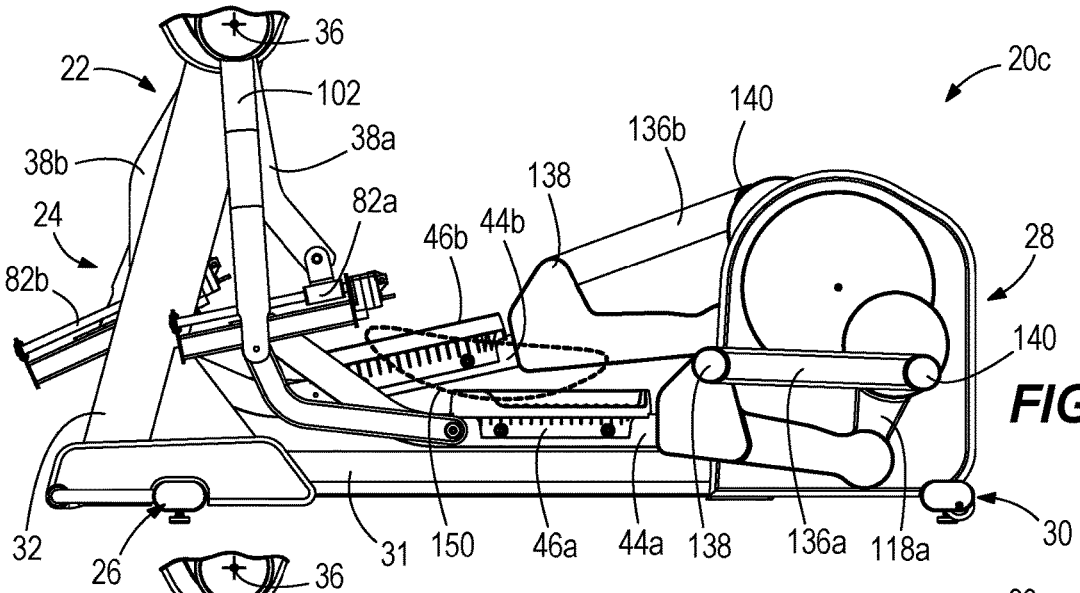
FIG. 13 is a side view of the third embodiment, showing an elliptical path of a foot pad when the adjustment devices on the foot pedal members are retracted.
Figure 14:
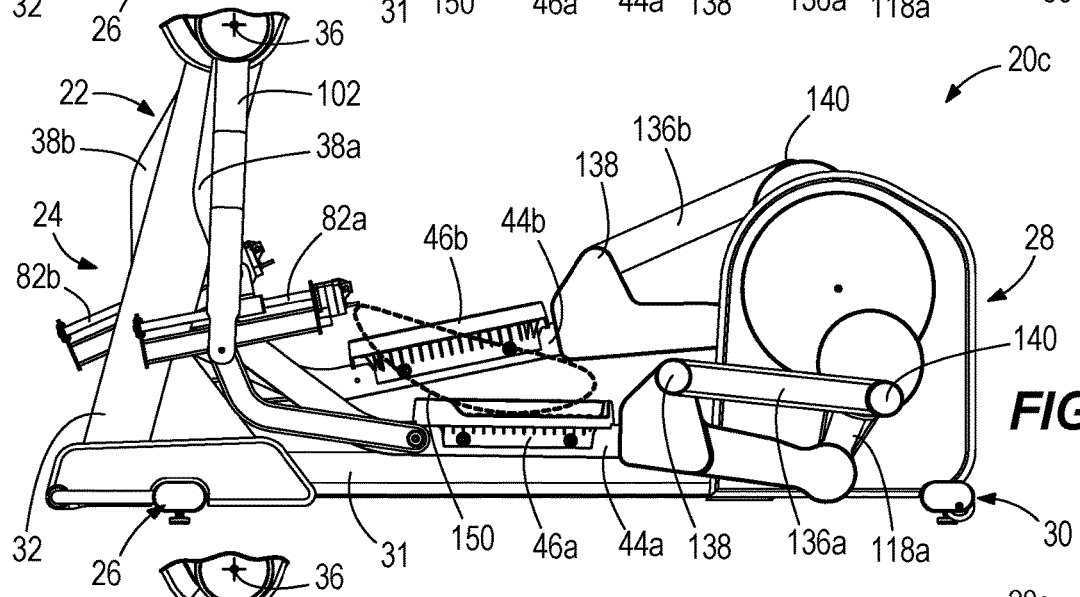
FIG. 14 is a view like FIG. 13, showing the elliptical path when the adjustment devices are partially extended.
Figure 15:
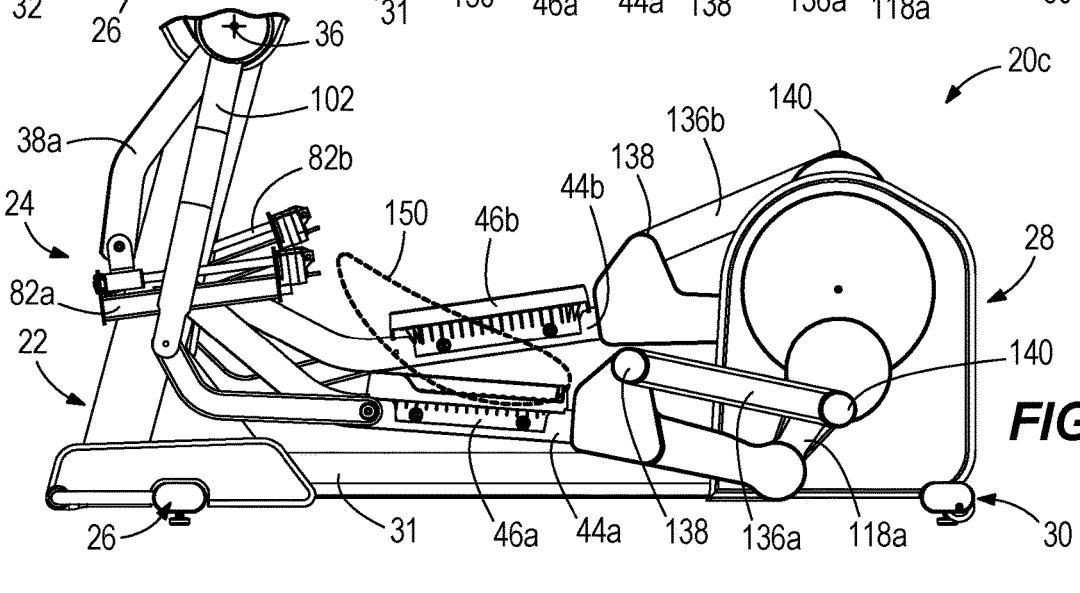
FIG. 15 is a view like FIG. 13, showing the elliptical path when the adjustment devices are fully extended.
Figure 16:
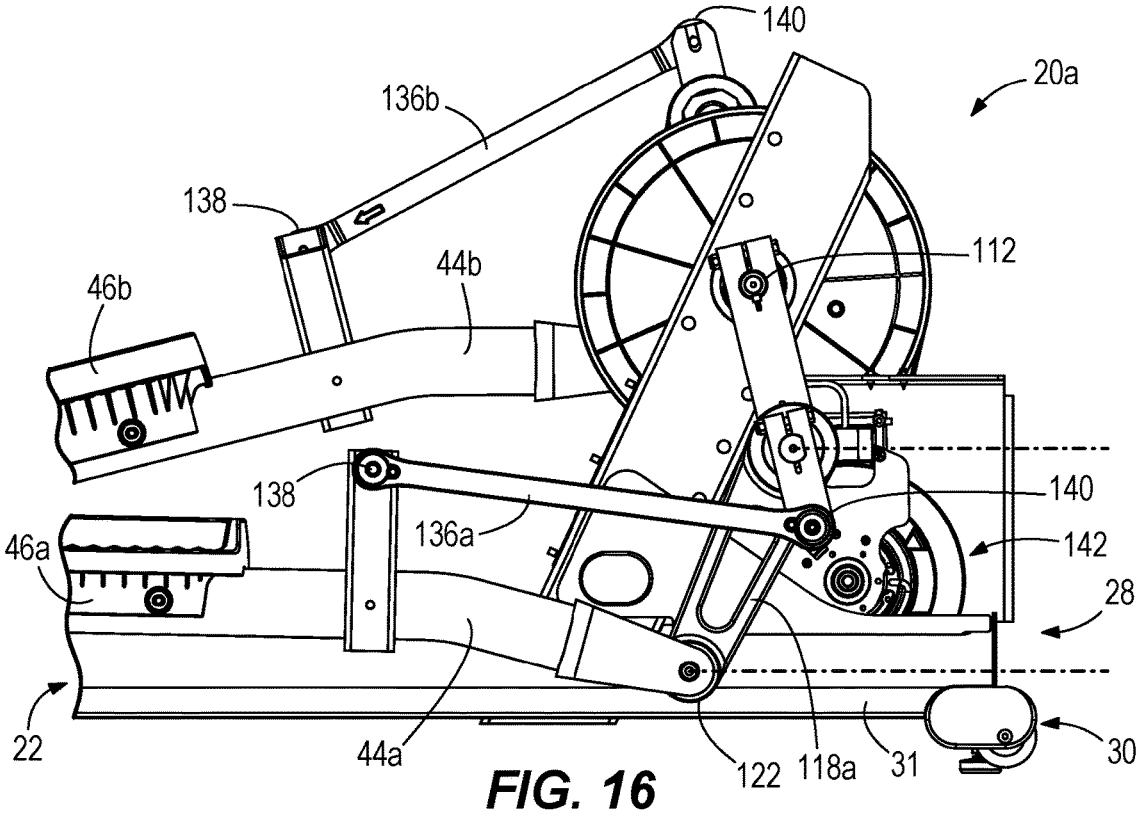
FIG. 16 is a closer view of rear portions of the first, second and third embodiments.

FIGS. 11-14 depict a third embodiment of the exercise machine 20*c*, in which the adjustment devices are pivotally coupled to a respective one of the rocker arms 38*a*, 38*b* and fixedly coupled to a respective one of the pedal members 44*a*, 44*b*. In this example the linear actuator 84 includes a carriage 152 that is pivotally coupled to the respective rocker arm 38*a*, 38*b* and engaged via a threaded connection with the positioning screw 90. Actuation of the linear actuator 84 via actuation of the electric motor 86 causes rotation of the positioning screw 90 (as described herein above) which thereby causes axial movement of the carriage 152 along the positioning screw 90. This adjusts the relative positions of the respective rocker arm 38*a*, 38*b* and pedal member 44*a*, 44*b*, which thereby adjusts the elliptical path 150, as shown in FIGS. 13-15. In the illustrated example, the positioning screw 90 is mounted to a support housing 154 that is fixed to the forward end portion of the respective pedal member 44*a*, 44*b*. The support housing 154 also has smooth stationary shafts 156 that are disposed on opposite sides of the positioning screw 90. The carriage 152 has bearing passages 158 that slide along the smooth stationary shafts 156 as the positioning screw 90 is rotated. The carriage 152 has a pivot pin 160 that is received in a pivot bore 162 through the lower end portion of the respective rocker arm 38*a*, 38*b*. The configuration of the linear actuator 84 can vary from what is shown and described. The configuration of the carriage 152 and support housing 154 can vary from what is shown.

Figure 17:
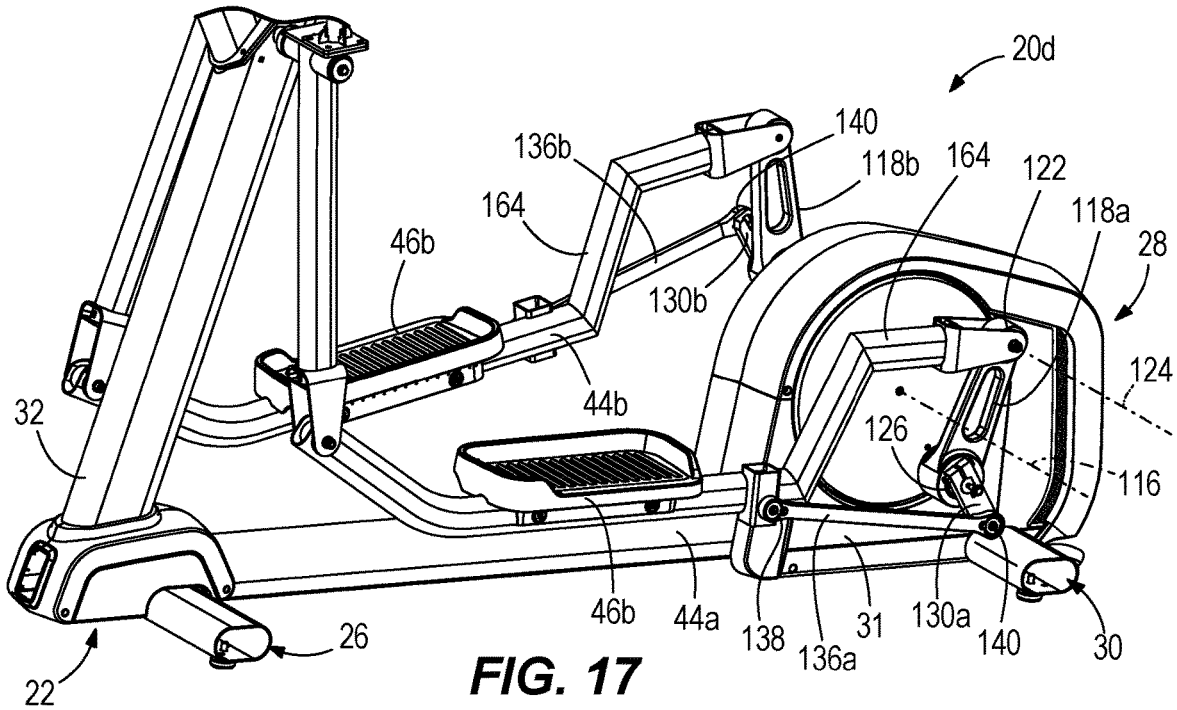
FIG. 17 is a perspective view of a fourth embodiment of an exercise machine according to the present disclosure.
Figure 18:
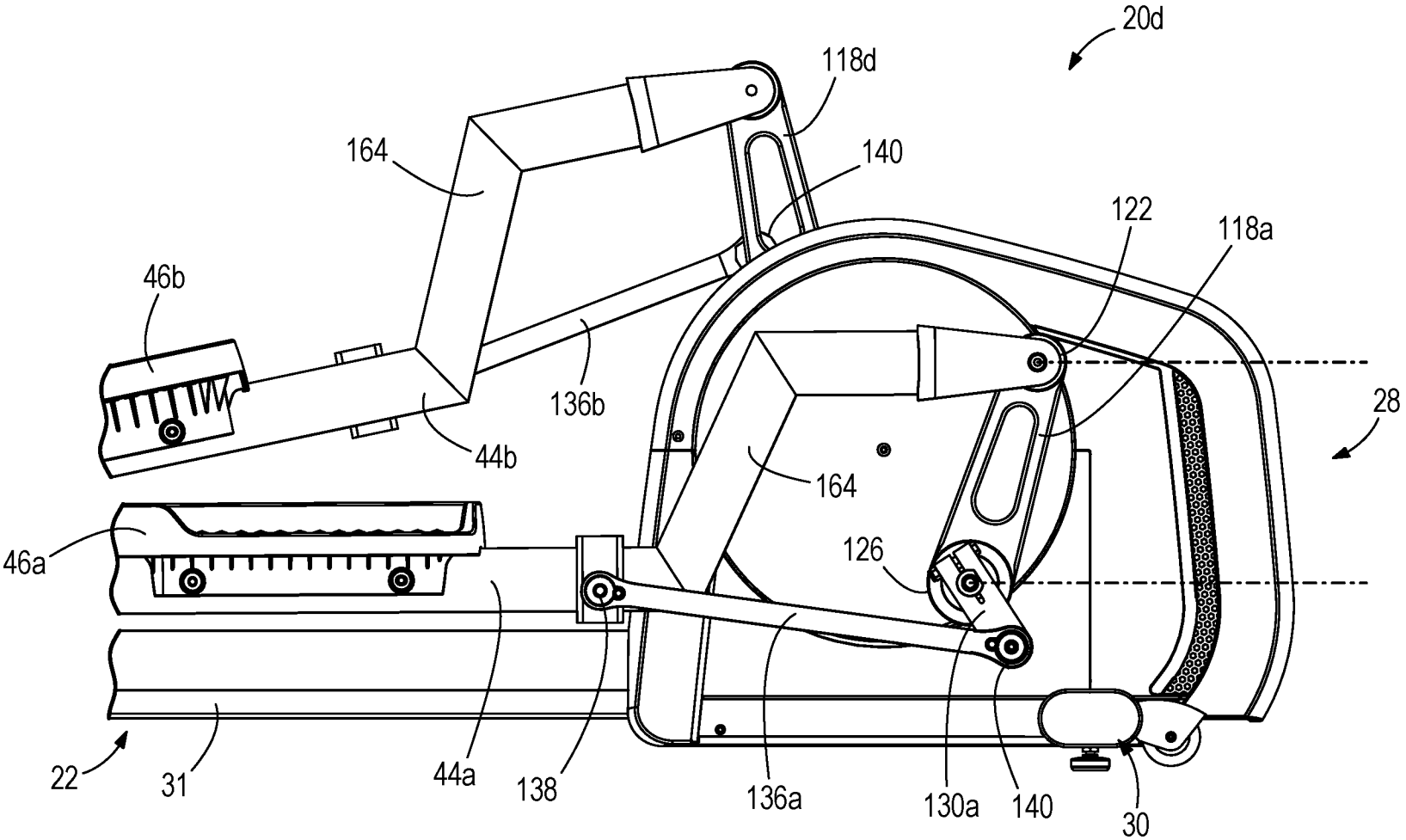
FIG. 18 is a closer view of rear portions of the fourth embodiment.

FIGS. 17 and 18 depict a fourth embodiment of the exercise machine 20*d* wherein the pedal-link arm pivot axis 124 is located vertically higher than the common crank axis 116 in an orientation where the rear link arms 118*a*, 118*b* are subjected to compression forces from the weight of the user. The rear end portion of the pedal member 44*a*, 44*b* includes L-shaped elbow 164 that positions the pedal-link arm axis 124 higher than the common crank axis 116 and this example omits the extension member 128, which is present in the first embodiment and which is replaced by a shorter member or bracket. Contrary to the previous embodiments, the weight of the user standing on the foot pads 46*a*, 46*b* places compression forces on the rear link arms 118*a*, 118*b* rather than tension forces.

Thus it can be seen that examples in the present disclosure facilitate active adjustment of the shape of the elliptical exercise motion without the need for rollers and tracks, or linear bearings and guides, which can require additional maintenance and cause undesirable noise.

Although specific advantages have been enumerated above, various embodiments may include some, none, or all of the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. An exercise machine for performing a striding exercise motion, the exercise machine comprising:

a frame;

first and second pedal members;

first and second foot pads on the first and second pedal members, respectively, wherein the first and second foot pads are configured to move in respective elliptical paths during the striding exercise motion;

first and second rocker arms pivotably coupled to the frame, wherein the first and second pedal members depend from and pivot along with the first and second rocker arms relative to the frame;

an actuator configured to actively adjust and set a position of at least one of the first and second foot pads relative to the frame to thereby vary a shape of the respective elliptical path of said at least one of the first and second foot pads; and a controller configured to electrically control the actuator to actively adjust and set said shape of the respective elliptical path of said at least one of the first and second foot pads, first and second drank arms rotably coupled to a rear portion of the frame along a common crank axis, wherein the first and second crank arms rotate together and remain fixed relative to each other during the striding exercise motion; and first and second rear link arms having a first portion that is pivotably coupled to a rear portion of the first and second pedal members, respectively, at a pedal-link arm pivot axis, the first and second rear link arms having an opposite, second portion that is pivotably coupled to the first and second crank arms, respectively, at a pedal-crank arm pivot axis, the first and second rear link arms being configured to facilitate movement of the first and second pedal members relative to the first and second crank arms.

2. The exercise machine according to claim 1, further comprising an input device, wherein the controller is configured to control the actuator according to a user input entered to the controller via the input device.

3. The exercise machine according to claim 2, wherein the input device comprises a touch screen configured to display operating characteristics of the exercise machine.

4. The exercise machine according to claim 1, wherein the actuator comprises a motor that rotates a positioning screw to thereby cause linear movement of a carriage.

5. The exercise machine according to claim 4, wherein the carriage further comprises a bushing that rides along a support bar positioned parallel to the positioning screw.

6. The exercise machine according to claim 1, wherein the controller is configured to automatically control the actuator according to a stored exercise program.

7. The exercise machine according to claim 1, wherein the controller is configured to automatically control the actuator before, during and after completion of the striding exercise motion.

8. The exercise machine according to claim 1, wherein the respective elliptical paths have a shape with a horizontal length which remains substantially constant during adjustment via the actuator.

9. The exercise machine according to claim 1, wherein the actuator comprises a linear actuator.

10. The exercise machine according to claim 9, wherein the linear actuator is contained within a housing.

11. The exercise machine according to claim 1, wherein the actuator is configured to change a fore-aft range of motion through which a respective one of the first rocker arm and the second rocker arms pivots with respect to the frame during the striding exercise motion.

12. The exercise machine according to claim 1, wherein the actuator comprises a linear actuator having a motor which positions a positioning screw with respect to an engagement nut, wherein rotation of the positioning screw in a first direction lengthens the linear actuator and wherein rotation of the positioning screw in an opposite, second direction shortens the linear actuator.

13. An exercise machine for performing a striding exercise motion, the exercise machine comprising:

a frame;

first and second pedal members;

first and second foot pads on the first and second pedal members, respectively, wherein the first and second footpads are configured to move in respective elliptical paths during the striding exercise motion;

first and, second rocker arms pivotably coupled to the frame, wherein the first and second pedal members depend from and pivot along with the first and second rocker arms relative to the frame;

an actuator configured to actively adjust and set a position of at least one of the first and second foot pads relative to the frame to thereby vary a shape of the respective elliptical path of said at least one of the first and second thot pads;

a controller configured to electrically control the actuator to actively adjust and set said shape of the respective elliptical path of said at least one of the first and second footpads, wherein the frame has a front portion and a rear portion, and the first and second pedal members have a front pedal portion and a rear pedal portion, and farther comprising first and second crank arms being rotatably coupled to the rear portion of the frame along a common crank axis, wherein the first and second crank arms are fixed relative to each other along the common crank axis such that the first and second crank arms rotate together and remain at a fixed angles relative to each other during operation of the exercise machine; and first and second rear link arms that pivotably couple the rear pedal portions to the first and second crank arms, respectively, and thereby facilitate adjustment of the first and second pedal members relative to the first and second crank arms and more particularly to facilitate movement of the rear pedal portions relative to the first and second crank antis during the striding exercise motion, wherein the first and second rear link arms have a first portion that is pivotably coupled to the first and second pedal members, respectively, at a pedal-link arm pivot axis, and wherein the first and second rear link arms have an opposite, second portion that is pivotably coupled to the first and second crank arms, respectively, at a pedal-crank arm pivot axis which is offset from the pedal-link arm pivot axis.

14. The exercise machine according to claim 13, further comprising first and second crank extensions that axially extend from the first and second crank arms, respectively, along the pedal-crank arm pivot axis, and wherein the first and second crank extensions rotate with and remain parallel to the first and second crank arms as the first and second crank arms rotate with respect to the common crank axis.

15. The exercise machine according to claim 14, further comprising first and second guide members each having a first guide end portion pivotably coupled to the first and second pedal members, respectively, and a second guide end portion pivotably coupled to the first and second crank extensions, respectively.

16. The exercise machine according to claim 13, further comprising a resistance mechanism mounted to the frame at the rear portion of the frame, and being coupled to the first and second crank arms, the resistance mechanism configured to provide resistance to rotation of the first and second crank arms about the common crank axis.

17. The exercise machine according to claim 16, wherein the controller is configured to control the resistance mechanism.

18. The exercise machine according to claim 13, wherein adjustment of a position of the first and second pedal members relative to the first and second rocker arms is accommodated by pivoting of the first and second rear link arms, respectively, about the pedal-link arm pivot axis and the pedal-crank arm pivot axis.

* * * * *